United States Patent [19]

Francois et al.

[11] Patent Number: 4,964,813

[45] Date of Patent: Oct. 23, 1990

[54] BRANCH CONNECTION ACCESSORY DEVICE FOR AN INSULATED BRANCH CABLE TO BE CONNECTED TO AN INSULATED MAIN CABLE

[75] Inventors: Pierre Francois, Limoges; Michel H. M. F. Prodel, Arnac Pompadour, both of France

[73] Assignee: S.I.C.A.M.E. Societe Industrielle de Construction, Arnac Pompadour, France

[21] Appl. No.: 394,473

[22] Filed: Aug. 16, 1989

[30] Foreign Application Priority Data

Aug. 22, 1988 [FR] France ..... 88 11085

[51] Int. Cl.[5] ..... H01R 13/52

[52] U.S. Cl. ..... 439/521; 439/781; 439/811

[58] Field of Search ..... 439/411, 412, 519, 520, 439/521, 522, 523, 781, 782, 801, 805–808, 811, 812, 813, 814

[56] References Cited

U.S. PATENT DOCUMENTS

| | | | |
|---|---|---|---|
| 1,943,020 | 1/1934 | Johnson | 439/781 |
| 2,679,032 | 5/1954 | Thomas, Jr. et al. | 439/781 |
| 3,869,189 | 3/1975 | McCurdy | 439/523 X |
| 4,643,512 | 2/1987 | Prodel | 439/412 |

FOREIGN PATENT DOCUMENTS

| | | |
|---|---|---|
| 0239428 | 9/1987 | European Pat. Off. . |
| 2394902 | 1/1979 | France . |
| 2601516 | 8/1988 | France . |
| 1571720 | 7/1980 | United Kingdom . |

*Primary Examiner*—Neil Abrams
*Assistant Examiner*—Khiem Nguyen
*Attorney, Agent, or Firm*—Charles E. Brown; Charles A. Brown

[57] ABSTRACT

A branch connection accessory device for an insulated branch cable to be connected to an insulated main cable comprises a two-part clamping system. This is adapted to clamp the branch cable between the two parts, at least a first of which is electrically conductive. An insulated conductor appendix is factory-fitted, electrically connected and mechanically joined to the first part. It is adapted to be connected to a non-separate branch connector having two jaws, to one of which the appendix is connected and the other of which is connected to the main cable. An insulative seal envelops the device, a hole in the seal providing access to the first part. A well in the seal in line with the other part enable the latter to be operated. The device therefore constitutes a sealed, insulative branch connection accessory device.

21 Claims, 3 Drawing Sheets

FIG. 1
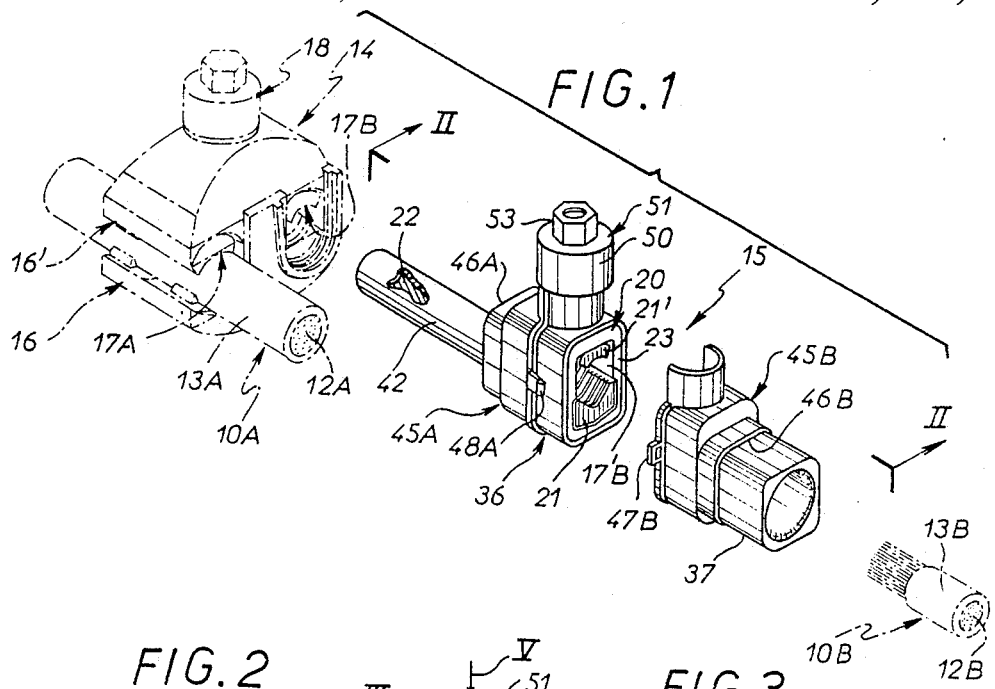
FIG. 2
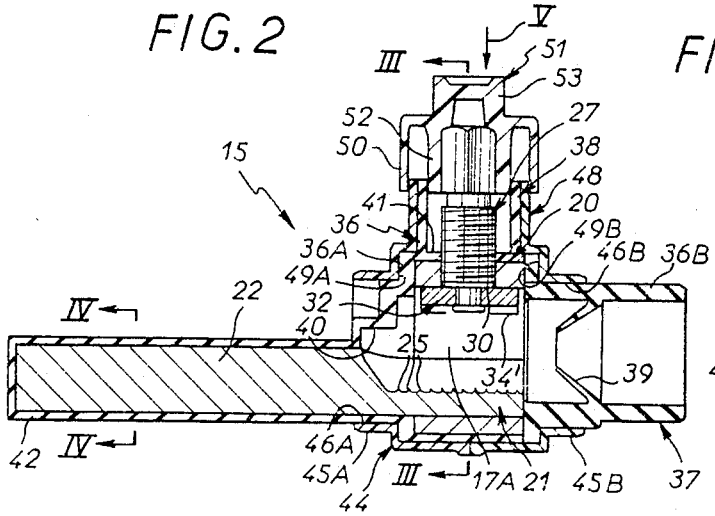
FIG. 3
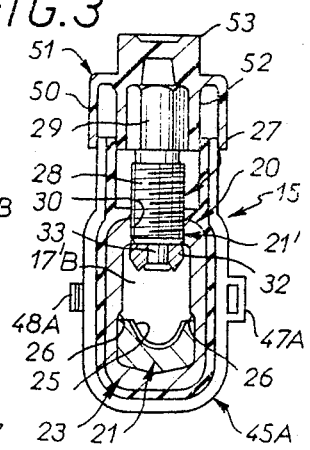
FIG. 4
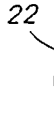
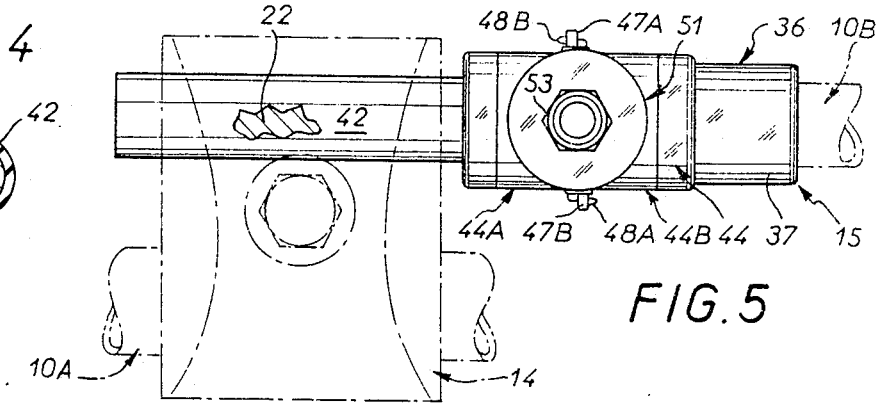
FIG. 5

BRANCH CONNECTION ACCESSORY DEVICE FOR AN INSULATED BRANCH CABLE TO BE CONNECTED TO AN INSULATED MAIN CABLE

BACKGROUND OF THE INVENTION

1. Field of the Invention

The present invention concerns a branch connection accessory device for connecting a branch cable to a main cable in an electrically insulated and sealed manner in such a way as to confer at minimum cost upon a non-separate branch insulated branch connector at least some of the advantages of a separate branch insulated branch connector.

2. Description of the Prior Art

Known non-separate branch connectors generally comprise two jaws which define between them at least two passages, one for fitting them to a main cable and the other for inserting at least one branch cable, with an assembly pin, usually a single such pin, for clamping them together so that these passages are closed simultaneously.

They have the advantage of simplicity and compact overall dimensions allied with low unit cost even though they can have remarkable insulation qualities if required and as described, for example, in published French patent application No. 2 601 516.

On the other hand, they have the disadvantage of engaging the branch cable and the main cable simultaneously, so that demounting the branch cable necessarily entails removing them from the main cable.

They then leave deep wounds in the main cable, especially if this is an insulated cable where the insulation has had to be perforated to fit them.

It is difficult to repair these wounds effectively, even if the damaged main cable is taped up locally in an appropriate way.

Under these conditions, if the operations to mount a branch cable on a main cable and to demount it therefrom have to be repeated, the main cable may quickly become irredeemably damaged.

Obviously this disadvantage is not found with separate branch connectors of the type described, for example, in French patent No. 2 566 191, to which the previously mentioned published French patent application constitutes a patent of addition.

In addition to the jaw forming a body common to the main cable and the branch cable these known separate branch connectors comprise separate jaws for the main cable and the branch cable with each of which is associated a respective clamping pin.

It is therefore advantageously possible to demount a branch cable without interfering with the clamping of the connector onto the main cable.

However, these separate branch connectors are more costly than non-separate branch connectors.

SUMMARY OF THE INVENTION

The present invention consists in a branch connection accessory device for an insulated branch cable to be connected to an insulated main cable comprising a clamping system in two parts adapted to clamp said branch cable between said two parts at least a first of which is electrically conductive, an insulated conductor appendix factory-fitted, electrically connected and mechanically joined to said first part and adapted to be connected to a non-separate branch connector having two jaws, to one of which said appendix is connected and the other of which is connected to said main cable, an insulative seal enveloping said device, a hole in said seal providing access to said first part and a well in said seal in line with the other of said parts for operating said other part, whereby the device constitutes a sealed, insulative branch connection accessory device.

In this way when the branch cable is attached to the branch connection accessory device in accordance with the invention the latter is itself attached by way of its conductor appendix to the non-separate branch connector fitted to the main cable.

The non-separate branch connector can then remain permanently on the main cable, mounting and demounting of the branch cable then involving only the branch connection accessory device in accordance with the invention.

It is exactly as if the combination of this branch connection accessory device and the non-separate branch connector together formed a separate branch connector.

The characteristics and advantages of the invention will emerge from the following description given by way of non-limiting example only with reference to the appended diagrammatic drawings.

BRIEF DESCRIPTION OF THE DRAWINGS

FIG. 1 shows in full outline a partially cut away exploded perspective view of a branch connection accessory device in accordance with the invention showing in chain-dotted outline a perspective view of the connector with which it is adapted to cooperate.

FIG. 2 is a view of it in axial cross-section on the line II—II in FIG. 1.

FIGS. 3 and 4 are views of it in transverse cross-section on the lines III—III and IV—IV, respectively, in FIG. 2.

FIG. 5 is a partially cut away plan view of it as seen in the direction of the arrow V in FIG. 2 showing in chain-dotted outline the connector as shown in FIG. 1.

DESCRIPTION OF THE PREFERRED EMBODIMENTS

Figure 6:
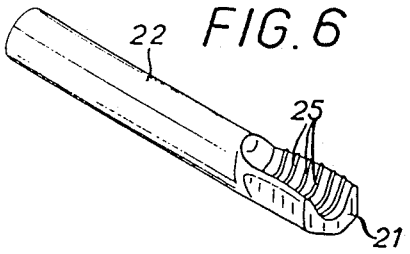
FIG. 6 is a perspective view of the conductor appendix that the branch connection accessory device in accordance with the invention comprises and of the clamping member to which the conductor appendix is fixed, shown in isolation.

As shown in chain-dotted outline in FIGS. 1 and 5, the overall objective is to connect a branch cable 10B to a main cable 10A.

In the embodiment shown in these figures, the main cable 10A and the branch cable 10B are both insulated cables, that is to say cables comprising around a conductive core 12A, 12B an insulative material sheath 13A, 13B.

In accordance with the invention, the branch cable 10B is connected to the main cable 10A by means of a known type non-separate branch connector 14 preferably of the insulated kind and a branch connection accessory device 15.

As the non-separate branch connector 14 forms no part of the present invention it will not be described in complete detail here.

Suffice to say that in the known manner it comprises two jaws 16, 16' which define between them two passages 17A, 17B each adapted to receive any cable or other conductive member of the same kind and which are conjointly acted on by a single fastening pin 18 to clamp them together.

The non-separate branch connector 14 is adapted to have its passage 17A fitted to the main cable 10A.

It is normally adapted to receive the branch cable 10B in its passage 17B.

In accordance with the invention, the branch connection accessory device is substituted for the branch cable in the sense that it is interposed between the latter and the non-separate branch connector 14.

As is more clearly seen in FIGS. 2 and 3, the branch connection accessory device 15 in accordance with the invention comprises, in a similar way to a connector, a clamping system 20 formed of two parts 21, 21' which are adapted to clamp between them any cable, for example the branch cable 10B; at least one of them, in this instance the part 21, is electrically conductive and said conductive part 21 is factory-fitted with a sealed, insulated conductor appendix 22 which is mechanically joined and electrically connected to it and which is adapted to be connected to the combination of the main cable 10A and the non-separate branch connector 14 attached thereto.

In the embodiment shown in FIGS. 1 through 6 the conductive part 21 of the clamping system 20 is a jaw acting against a cage 23 which defines with it a passage 17'B adapted to receive the branch cable 10B and with which the other part 21' is engaged screwthread-fashion, intersecting the passage 17'B transversely.

The cage 23 is a hollow section with a generally rectangular transverse cross-section having rounded corners.

The jaw constituting the conductive part 21 forms internally, at the end towards the passage 17'B, a cradle which extends axially and the surface of which is formed with transverse striations 25.

The jaw constituting the conductive part 21 has an external cross-section complementary to that of the cage 23 against which it acts and, for retaining it, the latter has inside it two recesses 26 facing towards each other.

The conductor appendix 22 with which the conductive part 21 is fitted comprises a section of circular cross-section cylindrical rod in one piece with the conductive part 21.

The whole is made from aluminum alloy.

The same applies to the cage 23.

The other part 21' of the clamping system 20 comprises a clamping screw 27 with a threaded shank 28 and a screwhead 29.

The threaded shank 28 of the clamping screw is threaded into the cage 23, on the side of the latter opposite the jaw constituting the conductive part 21. To this end the cage 23 has a screwthreaded hole 30 in line with the median part of the jaw.

The part 21' further comprises inside the cage 23 and parallel to the jaw constituting the conductive part 21 a jaw 32 which can rotate freely at the end of the clamping screw 27.

To this end the jaw 32 is crimped to the end of an extension 33 to the threaded shank 28 of the clamping screw 27.

Like the jaw constituting the conductive part 21 it extends axially and is formed with two longitudinal teeth 34'.

The clamping system 20 is enveloped in an insulative seal 36 of a durably deformable elastic material forming a passage 37 for the branch cable 10B providing access to the conductive part 21 and a well 38 in line with the other part 21' to enable the latter to be operated.

The passage 37 is cylindrical and in line with the transverse section of the cage 23 of the clamping system 20, on the side thereof opposite the conductor appendix 22. Projecting internally of it, substantially half-way along it, is a durably and elastically deformable lip 39 which is generally frustoconical in shape and extends towards the cage 23, restricting the aperture thereof.

On the other side of the cage 23 of the clamping system 20 relative to the passage 37 thus provided, and therefore on the side towards the conductor appendix 22, the wall of the insulative sleeve 36 is reinforced, leaving a recess 40 at the corresponding end of the conductive part 21.

The insulative seal 36 is axially keyed to the cage 23 by its wall as reinforced in this manner and by the passage 37 that it forms.

It is in two separate parts 36A, 36B, the former comprising its reinforced wall and the well 38 and surrounding the cage 23 and the latter comprising the passage 37, being butt-jointed to the cage 23 and adjoining the former at its end.

The well 38 that it comprises extends laterally relative to the cage 23 around the screwthreaded hole in the latter and has a bottom 41 in contact with the cage 23 in which is a hole to allow the threaded shank 38 of the clamping screw 27 to pass through it.

The insulative seal 36 extends continuously over the section of bar constituting the conductor appendix 22.

Its part 36A forms a blind socket 42 for the conductor appendix 22, which is an exact fit in it.

As a result, the branch connection accessory device 15 in accordance with the invention constitutes a sealed, insulative branch connection accessory device.

The insulative seal 36 that it incorporates is made from a durably deformable elastic material and is disposed, in an elastically stressed state, in a casing 44 formed of two hard insulative material shells 45A, 45B fastened together in an appropriate way. The casing 44 has an opening 46B providing free access to the passage 37 provided by the insulative seal 36 for the branch cable 10B and a chimney 48 surrounding the well 38 in the latter.

The sealing plane between the shells 45A, 45B of the casing 44 lies transversely to the cage 23 of the clamping system 20, on the axis of the clamping screw 27, so that the shells 45A, 45B each form one half of the chimney 28 and so that the opening 46B is part of the shell 45B.

The shell 45A has in corresponding relationship to the opening 46B an opening 46A through which extends to the outside the conductor appendix 22 sheathed in the socket 42 formed for it by the insulative seal 36.

The two shells 45A, 45B of the casing 44 simply clip together with a snap-fastener action.

To this end each of them features in corresponding relationship along their facing edge, on one side a lug 47A, 47B and on the other side a lug 48A, 48B adapted to hook over the opposite lug 47B, 47A.

Their transverse shoulders 49A, 49B press the corresponding parts 36A, 36B of the insulative seal 36 against the edges of the cage 23 of the clamping system 20.

The clamping screw 27 is attached to a skirt 50 which surrounds the chimney 48 of the casing 44.

The skirt 50 forms part of a cap 51 which has on its inside a central core 52 engaged with the head 29 of the clamping screw 27 and on its outside an axial boss 53 forming a nut for rotating the combination that it forms with the clamping screw 27.

The exterior wall of the central core 52 of the cap 51 preferably has a transverse cross-section which decreases slightly towards the cage 23 of the clamping system 20 so that when inserted into the well 38 in the insulative seal 36 the central core 52, being frustoconical in shape, presses the well 38 against the chimney 48 of the casing 44 which surrounds it, while the chimney 48 is braced externally by the corresponding skirt 50.

Figure 14:
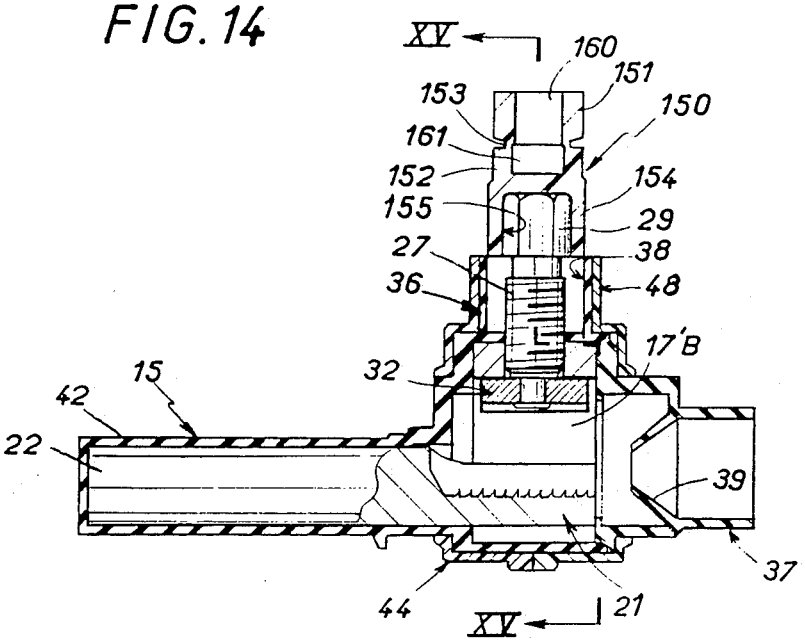
FIG. 14 is a view in axial cross-section similar to that of FIG. 2 for one embodiment.
Figure 15:
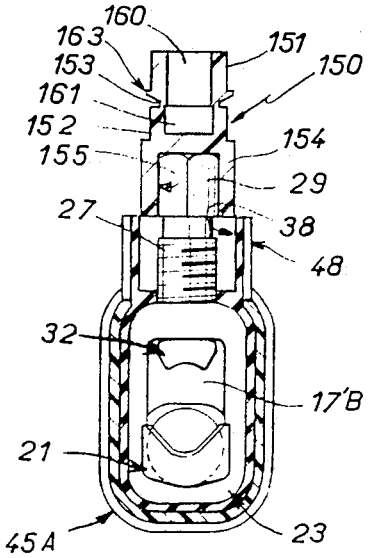
FIG. 15 is a view of this embodiment in transverse cross-section on the line XV—XV in FIG. 14.

As an alternative to this arrangement, and as shown in FIGS. 14 and 15, the head 29 of the clamping screw 27, which is generally hexagonal, is fitted with an end-piece 150 of hard insulative material attached to the head 29 by pressing and adhesive bonding. The end-piece 150 essentially comprises in its upper part a hexagonal clamping/handling head 151 surmounting a lower unclamping part 152 which is also hexagonal and the same size as the head 151, being separated from the latter by a calibrated rupture groove 153. In its lower part it comprises a base 154 the outside of which is generally cylindrical with a slight taper, the diameter increasing from its lower end towards its upper end, so that it is adapted to be inserted in a sealed way in rotation and in translation into the well 38 of the insulative seal 36 braced externally by the chimney 48 of the casing 44 which surrounds it and comprising internally a hexagonal housing 155 cooperating with the head 29 of the clamping screw 27 to screw or unscrew it.

Because of the calibrated rupture groove 153 the end-piece 150 is of what is usually called the "break-off" type.

When it has been broken off at the groove 153 the remaining hexagonal part 152 can be used to unscrew the clamping screw 27 if necessary.

The clamping/handling head 151 of the break-off end-piece 150 comprises on its inside a weight-reducing cylindrical cavity 160 the diameter of which is slightly greater than that of a weight-reducing cylindrical cavity 161 that the underlying hexagonal part 152 comprises, the offset between the weight-reducing cavities 160 and 161 being at the level of the calibrated rupture groove 153 so as to obtain a clear and accurate break for a predetermined tightening torque.

Furthermore, the clamping/handling head 151 comprises at its corners and in its lower part, in a manner that is known per se, stop members 163 (FIG. 15) designed to prevent the wrench slipping over the lower hexagonal part 152 while the screw is being tightened down.

To use the branch connection accessory device 15 in accordance with the invention the conductor appendix 22 of the branch connection accessory device 15 sheathed in the socket 42 of the insulative seal 36 is inserted between the jaws 16, 16' of the connector 14.

This can be done simultaneously with fitting of the connector 14 to the main cable 10A before the fastening pin 18 is operated to close the jaws 16, 16' of the latter simultaneously or virtually simultaneously onto the main cable 10A and onto the conductor appendix 22 of the branch connection accessory device 15.

However, if appropriate provisions are made for the jaws 16, 16' of the connector 14 to be at least temporarily held sufficiently open on the side by which they are adapted to be fitted onto the main cable 10A the branch connection accessory device 15 may have its conductor appendix 22 engaged in advance with the two jaws 16, 16' of the connector 14, which facilitates subsequent fitting of the latter to the main cable 10A.

In a case of this kind the branch connection accessory device 15 in accordance with the invention advantageously constitutes with the connector 14 an assembly that can be marketed and manipulated as such.

When, duly equipped with a branch connection accessory device 15 in accordance with the invention, a connector 14 is fitted to the main cable 10A all that is required to connect the branch cable 10B to the main cable 10A is to insert into the passage 37 in the insulative seal 36 of the branch connection accessory device 15 the previously bared end of the conductive core 12B of the branch cable 10B until, pushing past the elastically deformable lip 39 in the passage 37, the bared end enters the cage 23 of the clamping system 20, entering the corresponding passage 17'B, and then by means of the cap 51 to screw down the clamping screw 27 until the jaw 32 that the latter carries presses the bared end firmly against the jaw forming the conductive part 21.

Because of the insulative seal 36 and in particular its elastically deformable lip 39 and its well 38 gripped between the cap 51 and the casing 44 the seal is total and it is possible to demount the branch cable 10B without interfering with the main cable 10A.

Figure 8:
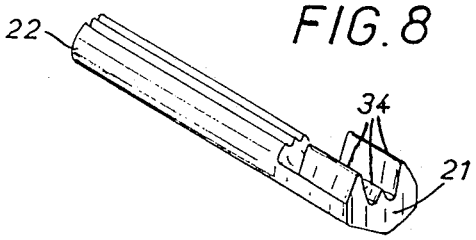
FIG. 8 is a perspective view similar to that of FIG. 6 for this embodiment.
Figure 7:
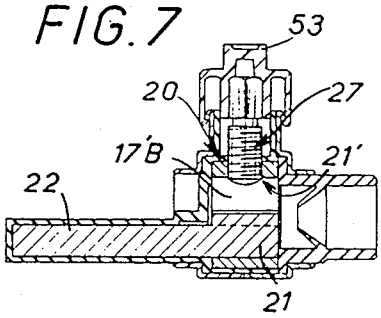
FIG. 7 is a view in axial cross-section similar to that of FIG. 2 for an alternative embodiment and to a smaller scale.

In the embodiment shown in FIGS. 7 and 8 the part 21' of the clamping system is the clamping screw 27 and the jaw constituting the conductive part 21 is provided with longitudinal teeth 34.

In the embodiments shown in FIGS. 9 through 12 the conductor appendix 22 fitted to the conductive part 21 of the clamping system 20 is a section of insulated cable to the bared end of the conductive core 55 of which the conductive part 21 is crimped in the factory.

The other end of this section of insulated cable is provided in a manner that is known in itself with a flexible cap 56, which may be filled with grease, to prevent penetration of moisture.

The insulative seal 36 includes a passage 57 for the section of insulated cable constituting the insulated conductor appendix 22 to exit through and the latter surrounds the insulative sheath 58 of the insulated cable section.

It will have been understood that strictly speaking it is the conductive core 55 of this section of insulated cable that forms the conductor appendix in accordance with the invention, while its insulative sheath 58 and the cap 56 form an equivalent of the previously described blind socket in the insulative seal 36.

Figure 10:
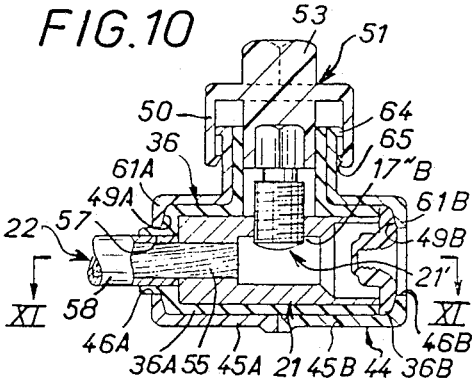
FIG. 10 is likewise a partial view in axial cross-section to a larger scale, similar to that of FIG. 2 and relating to a further embodiment.
Figure 11:
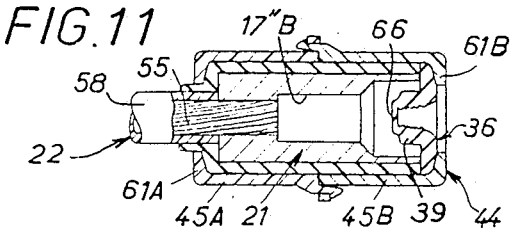
FIG. 11 is another view of this latter embodiment in axial cross-section on the line XI—XI in FIG. 10.

In the embodiment shown in FIGS. 10 and 11 the conductive part 21 of the clamping system 20 is a body which incorporates a bore 17'B adapted to receive the branch cable 10B, to be more precise the previously bared end of the conductive core 12B of the latter, and which is engaged screwthread-fashion the other part 21' of the clamping system 20, intersecting the bore 17'B transversely.

As previously, this other part 21' is a clamping screw 27.

The shells 45A, 45B of the casing 44 are therefore provided in line with their aperture 46A, 46B with an upstanding rim 61A, 61B which defines the aperture 46A, 46B and which forms directly the shoulder 49A, 49B whereby the casing 44 braces transversely the corresponding part 36A, 36B of the insulative seal 36 which it surrounds.

Figure 9:
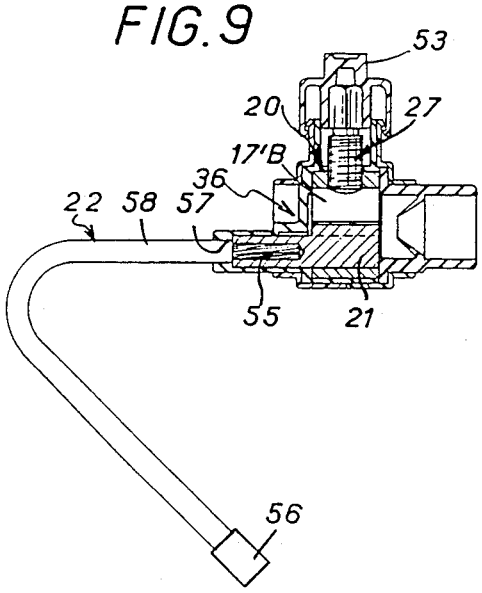
FIG. 9 is a partial view in axial cross-section to the same scale as FIG. 7, similar to that of FIG. 2 and relating to another embodiment.

In this embodiment, and also in the embodiments shown in FIGS. 7 through 9, the skirt 50 of the cap 51 attached to the clamping screw 27 is snap-fastened by axial retaining means to the chimney 48 of the casing 44.

To this end the chimney 48 has on it a bead 64 projecting radially outwards and the skirt 50 of the cap 51 has a hook-shaped bead 65 projecting radially inwards.

Otherwise the arrangements are of the same kind as previously described.

However, the aperture that the elastically deformable lip 39 of the insulative sleeve 36 delimits is initially closed off by a readily broken barrier 66.

In the foregoing description the conductive part 21 of the clamping system 20 is adapted to receive only one branch cable 10B, or to be more precise only one range of branch cables 10B.

As an alternative to this (FIG. 12) it can be adapted to receive in parallel at least two branch cables 10B, or to be more precise two ranges of branch cables 10B.

Figure 12:
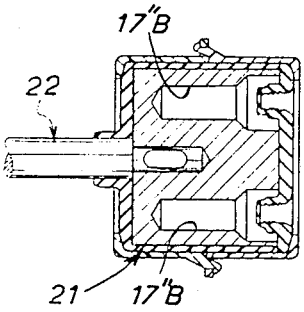
FIG. 12 is a view in axial cross-section similar to that of FIG. 10 for another embodiment.

In FIG. 12 this provision has been applied to the embodiment described with reference to FIGS. 10 and 11, the body constituting the conductive part 21 of the clamping system 20 comprising to this end two parallel bores 17''B, possibly of different diameter.

However, it could obviously be applied equally well to any of the other foregoing embodiments.

Figure 13:
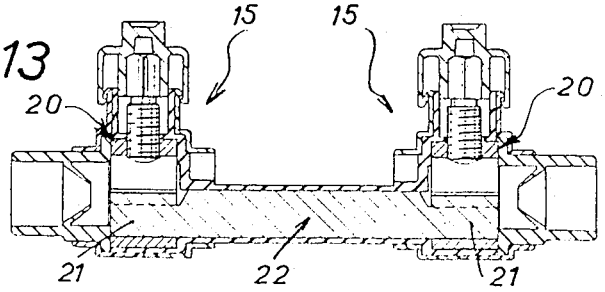
FIG. 13 is a view in axial cross-section similar to that of FIG. 2, to a different scale, for another embodiment of the branch connection accessory device in accordance with the invention.

In the arrangement shown in FIG. 13 the conductor appendix 22 fitted to the conductive part 21 of the clamping system 20 of a branch connection accessory device 15 in accordance with the invention is common to two such branch connection accessory devices 15, being fixed to the conductor part 21 of a first such branch connection accessory device 15 at one end and to a second of these at its other end.

In FIG. 13 this feature has been applied to an embodiment of the kind described with reference to FIG. 7.

As previously, however, it is obvious that it could equally well be applied to any other embodiment.

The present invention is not limited to the embodiments described and shown but encompasses any variant execution and/or combination of their various component parts.

Specifically, although in the embodiments described and shown it is in all cases a fixed part of the clamping system that is provided with an insulated conductor appendix, whether, duly locked to the latter, this part is braced by a cage or whether it forms of its own accord a fixed body, it is obvious that the scope of the present invention would not be exceeded by providing the conductor appendix on the other part of the clamping system, that is to say the part which is mobile relative to the previous part, although the embodiments described and shown would appear to be preferable from a practical point of view.

There is claimed:

1. Branch connection accessory device for an insulated branch cable to be connected to an insulated main cable comprising a clamping system in two parts adapted to clamp said branch cable between said two parts at least a first of which is electrically conductive, an insulated conductor appendix factory-fitted, electrically connected and mechanically joined to said first part and adapted to be connected to a non-separate branch connector having two jaws, to one of which said appendix is connected and the other of which is connected to said main cable, an insulative seal enveloping said device, a hole in said seal providing access to said first part and a well in said seal in line with the other of said parts for operating said other part, whereby the device constitutes a sealed, insulative branch connection accessory device.

2. Device according to claim 1 wherein said insulative seal is made from an elastic material and further comprising a casing incorporating two insulative material shells and means for fastening said shells together, said casing being adapted to contain said insulative seal in a stressed state and incorporating an opening provided access to said hole in said insulative seal and a chimney surrounding said well of said insulative seal.

3. Device according to claim 1 wherein said insulative seal is in two parts, a first part comprising said hole and a second part adapted to be joined to the end of said first part and comprising said well.

4. Device according to claim 1 wherein said hole is cylindrical and further comprising a frustoconical elastically deformable lip partially blocking said hole.

5. Device according to claim 4 wherein the aperture of said hole delimited by said lip is closed by a readily broken barrier.

6. Device according to claim 1 wherein said first part is a jaw and further comprising a cage against which said jaw acts and which defines with said jaw a passage for said branch cable, said other part comprising a screwthreaded member intersecting said passage transversely.

7. Device according to claim 3 wherein said first part is a jaw and further comprising a cage against which said jaw acts and which defines with said jaw a passage for said branch cable, said other part comprising a screwthreaded member intersecting said passage transversely, the part of said insulative seal incorporating said well surrounding said cage and its other part ending at said cage.

8. Device according to claim 1 wherein said first part is a body including a hole adapted to receive said branch cable and into which is screwed said other part which intersects said hole transversely.

9. Device according to claim 1 wherein said conductor appendix comprises a section of bar in one piece with said first part and said insulative seal extends continuously over said bar section, constituting a blind socket therefor.

10. Device according to claim 1 wherein said conductor appendix comprises a section of insulated cable to the end of the conductive core of which said first part is clamped and said insulative seal comprises an exit hole for said cable section which surrounds the insulation of said cable section.

11. Device according to claim 1 wherein said first part is adapted to receive at least two branch cables in parallel.

12. Device according to claim 1 wherein said conductor appendix is common to two branch connection accessory devices, having said first part of a respective device clamped to each end.

13. Device according to claim 1 wherein said first part forms a cradle with transverse striations or teeth on its surface.

14. Device according to claim 1 wherein said first part incorporates longitudinal teeth.

15. Device according to claim 1 wherein said other part comprises a clamping screw.

16. Device according to claim 15 wherein said other part further comprises a jaw freely rotatable at the end of said clamping screw.

17. Device according to claim 2 wherein said other part comprises a clamping screw, a skirt around said chimney attached to said clamping screw and a frusto-conical core inserted into said well and adapted to press said insulative sleeve against said chimney.

18. Device according to claim 17 further comprising axial retaining means securing said skirt to said chimney snap-fastener fashion.

19. Device according to claim 17 further comprising a cap of which said skirt and said core are parts, said core being engaged with said clamping screw, and which incorporates a nut-shaped external boss for rotating it and said clamping screw.

20. Device according to claim 18 further comprising a cap of which said skirt and said core are parts, said core being engaged with said clamping screw, and which incorporates a nut-shaped external boss for rotating it and said clamping screw.

21. Device according to claim 2 wherein said other part comprises a clamping screw which has at its upper end a head incorporating an insulative material end-piece comprising a clamping/handling upper part, an unclamping lower part and a calibrated rupture groove between said upper and lower parts and at its lower end a cylindrical base adapted to be inserted in a sealed manner into said well to rotate and move in translation therein.

* * * * *